US005924227A

United States Patent [19]

Sommers

[11] Patent Number: 5,924,227

[45] Date of Patent: Jul. 20, 1999

[54] INDEX CARD

[76] Inventor: Stephen J. Sommers, 323 S. Main St., South Bend, Ind. 46601

[21] Appl. No.: 08/906,056

[22] Filed: Aug. 5, 1997

[51] Int. Cl.[6] ..... B42F 13/12

[52] U.S. Cl. ..... 40/360; 40/124.09; 40/379; 407/79

[58] Field of Search ..... 40/360, 539, 124.09, 40/641, 359; 402/79; 283/36

[56] References Cited

U.S. PATENT DOCUMENTS

| | | | |
|---|---|---|---|
| 1,208,269 | 12/1916 | Belknap | 40/380 |
| 3,026,639 | 3/1962 | Lille | 40/124.09 |
| 3,970,397 | 7/1976 | Armstrong | 40/360 X |
| 4,190,151 | 2/1980 | Russell | 40/360 X |

FOREIGN PATENT DOCUMENTS

| | | | |
|---|---|---|---|
| 919859 | 2/1963 | United Kingdom | 40/379 |

*Primary Examiner*—Cassandra H. Davis
*Attorney, Agent, or Firm*—Baker & Daniels

[57] ABSTRACT

An index card for any index file (such as a lateral or flat index file or a rotary index file) is divided into upper and lower portion by a pair of score lines that extend inwardly from the lateral edges thereof and terminate at cut lines extending parallel to the side edges of the card. The cut lines extend parallel to the side edges of the card are interconnected by a cut line extending substantially parallel to the top and bottom of the card to thereby form a tab that extends from a folded edge formed when the upper portion of the card is folded about the score lines to overlie the lower portion of the card. Accordingly, indicia may be printed on the tab will be immediately available to the user of the file.

4 Claims, 3 Drawing Sheets

INDEX CARD

This invention relates to an index card for an index file.

BACKGROUND OF THE INVENTION

Both flat and rotary index files have become increasingly common. These files store information on index cards, which can be installed and removed from the index files with relative ease. Accordingly, index cards may be added to an existing file, and an obsolete index card may be easily removed and discarded. However, most index files use relatively small index cards, which have a very limited surface area for the information stored on the index card. Many index cards are supplied by vendors to their customers as advertising so that the customer may install the vendor's index card in the customer's index file. It is particularly important that such index cards supplied as advertising material have ample room for a description of the products and services provided by the vendor, and also have room for the display of other important information, such as all of the vendor's telephone and fax numbers, as well as the vendor's electronic mail address. While this information might be distributed over two or more cards, the user has a tendency to only use the cards in which the telephone number is displayed. Furthermore, it is desirable to provide index cards, particularly when supplied as advertising material, that prominently display the vendor's logo and telephone number. It is also desirable that the index card be able to fit into all popular index files, either rotary or flat. Since the distance between the rails supporting the index card may vary with index files made by different manufactures, it is also important that the index cards either fit, or may be easily made to fit, into a wide range of different index files.

SUMMARY OF THE INVENTION

According to the present invention, card stock is scored between the upper and lower edges thereof to provide a fold line. The fold line is at a distance from the lower edge of the card equal to the nominal size of most index cards used in common index files. A recess is cut in the upper portion of the card to form a tab projecting from the lower portion of the card. Accordingly, when the upper portion is folded about the score lines to form an index card, the tab projects above the fold line, so that identifying indicia or telephone numbers be printed on the tab such that when the index card is installed in an index file the telephone number or other indicia will be prominently displayed. The recess in the upper portion of the card from which the tap is cut exposes some material on the lower portion of the card. Identifying indicia, such as a logo, may be printed on the upper portion of the reverse side of the card, so that when the upper portion is folded about the score lines, the indicia will be prominently displayed on the front of the card. The upper portion covers a portion of the indicia printed below the score line when the upper portion is folded to lie upon the lower portion but, this indicia is easily exposed by merely lifting the upper portion of the score card. Accordingly, about three times the amount of information may be displayed on an index card of the present invention then is displayed on a conventional index card.

BRIEF DESCRIPTION OF THE DRAWINGS

These and other advantages of the present invention will become apparent from the following description with reference to the accompanying drawings, in which.

DESCRIPTION OF THE PREFERRED EMBODIMENT

Figure 7:
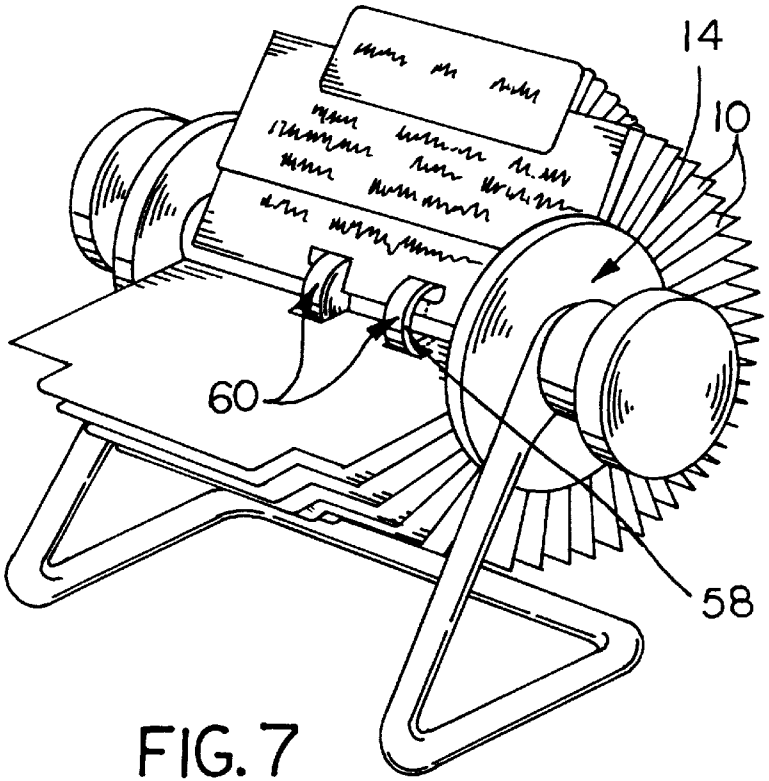
FIG. 7 is a view in perspective of a conventional rotary index file in which cards made pursuant to the teachings of the present invention have been installed.
Figure 6:
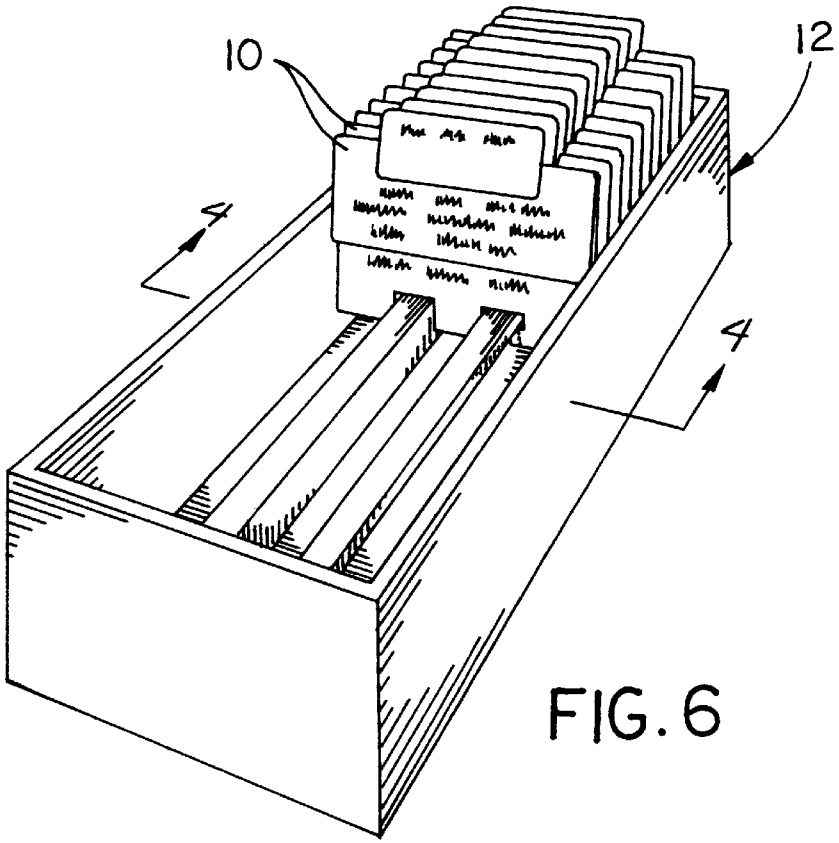
FIG. 6 is a view in perspective of an lateral index file in which cards made pursuant to the teachings of the present invention are shown installed.

Referring now to the drawings, when an index card generally indicated by the numeral 10 is adapted for use either in a lateral or flat index file generally indicated by the numeral 12 (FIG. 6) or in a conventional rotary index file generally indicated by the numeral 14 (FIG. 7).

Figure 2:
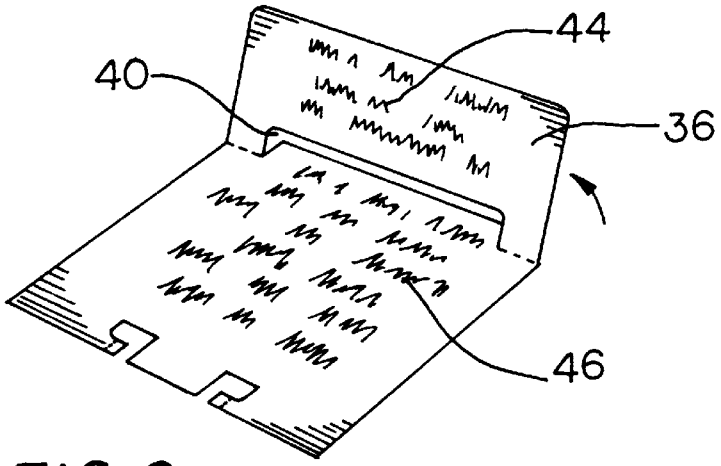
FIG. 2 is a view in perspective of the index card illustrated in FIG. 1, illustrating the manner in which the upper portion of the index card is folded about the score lines to form the index card of the present invention.
Figure 3:
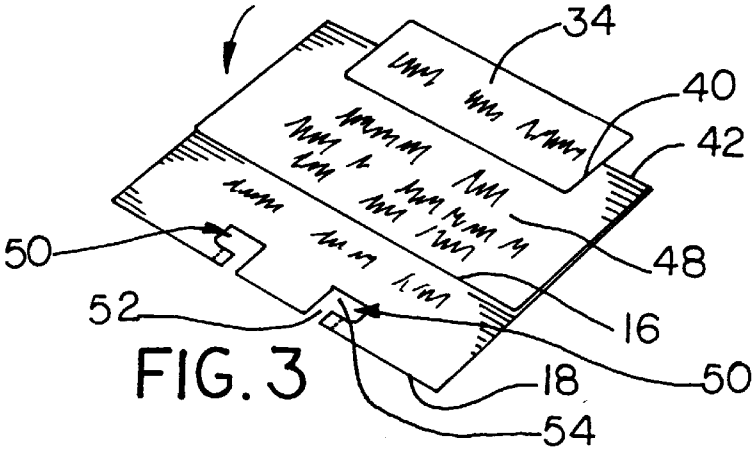
FIG. 3 is a view in perspective of the index card made pursuant to the teachings of the present invention after it has been folded.
Figure 1:
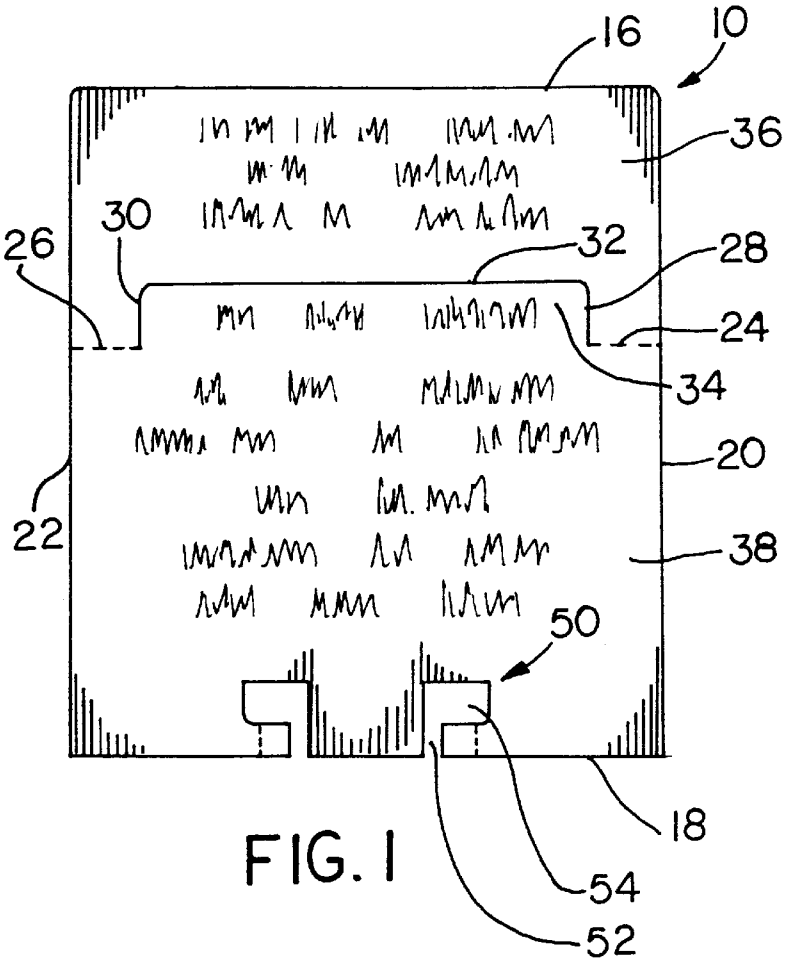
FIG. 1 is a plan view of an index card which has been scored and cut, before the upper portion thereof has been folded to form the index card according to the present invention.

The index card 10 includes an upper edge 16, a lower edge 18, and opposite side edges 20, 22. A pair of score lines 24, 26 each extend inwardly toward the other score line from each of the side edges 20, 22. Each of the score lines 24, 26 terminate at cut lines 28, 30 which extend parallel to one another and parallel to the side edges 20 and 22. A transverse cut line 32 interconnects the cut lines 28 and 30, and extends substantially parallel to the upper and lower edges 16, 18. Accordingly, the cut lines 28, 30 and 32 cooperate to define a tab 34 which extends from score lines 24, 26 toward the upper edge 16 of the card 10. As illustrated in FIGS. 1–3, the score lines 24, 26, and the cut lines 28, 30 and 32 divide the card 10 into an upper portion 36 and a lower portion 38. The upper portion 36 is folded around the score lines 24, 26 to overlie the lower portion 38, as illustrated in FIG. 3. Accordingly, a recess 40 is defined by the cut lines 28, 30 and 32, so that when the upper portion 36 is folded into the FIG. 3 position, the tab 34 projects above the score lines 24, 26 which, after folding, define a folded edge 42. The distance between the score lines 24, 26, (and, accordingly, the folded edge 42) and the lower edge 18 is substantially the same as the height of conventional index cards used in the index files 12 or 14. Accordingly, when the card 10 is folded into the FIG. 3 position the folded edge 42 will be, when the card 10 is installed in an index file, substantially the same height as a conventional index card. The tab 34, however, since it projects above the folded edge 42, will be immediately noticeable and accessible to the user of the index file. It will further be noted that the recess 40, when the card is fully folded into the FIG. 3 position, exposes a portion of the lower portion 38 just below the base of the tab 34. The distance between the score lines 24, 26 and the upper edge 16 is substantially less than the distance between the score lines 24, 26 from the lower edge 18 so that, when the upper portion 36 is folded to overlie the lower portion 38, a substantial distance remains between the edge 16, which before folding was the upper edge of the card and after folding lies between the folded edge 42 and the lower edge 18.

Since tab 34 is immediately noticeable when the card 10 is installed in an index file, important information, such as a telephone number, is printed on the tab 34. This information may extend below the folded edge 42 into that section of the lower portion 38 of card 10 exposed by the recess 40. Furthermore, indicia 44 may be printed on the upper portion of 36 of the card 10, and further indicia 46 may be printed from that portion to the lower portion 38 of the card 10 that is not exposed by the recess 40 when the card is folded for use as illustrated in FIG. 3. Furthermore, additional indicia 48 may be printed on the side of the portion 36 opposite the side on which the indicia 44 is printed. Accordingly, when the card is folded for installation into the index file, as shown in FIG. 3, the material printed on the tab 34 and the material 48 printed on the portion 36 is immediately visible. Accordingly, a logo or other appropriate advertising material may be represented by the indicia 48 and information such as the telephone number may be printed on the tab 34. The user then can lift the portion 36 to expose the indicia 46 printed on portion 38 and the indicia 44 printed on the portion 36 opposite the side of which the indicia 48 is printed. This material may be, for example, a description of the products and services offered, as well as additional telephone numbers, fax numbers, e-mail addresses, etc.

Figure 5:
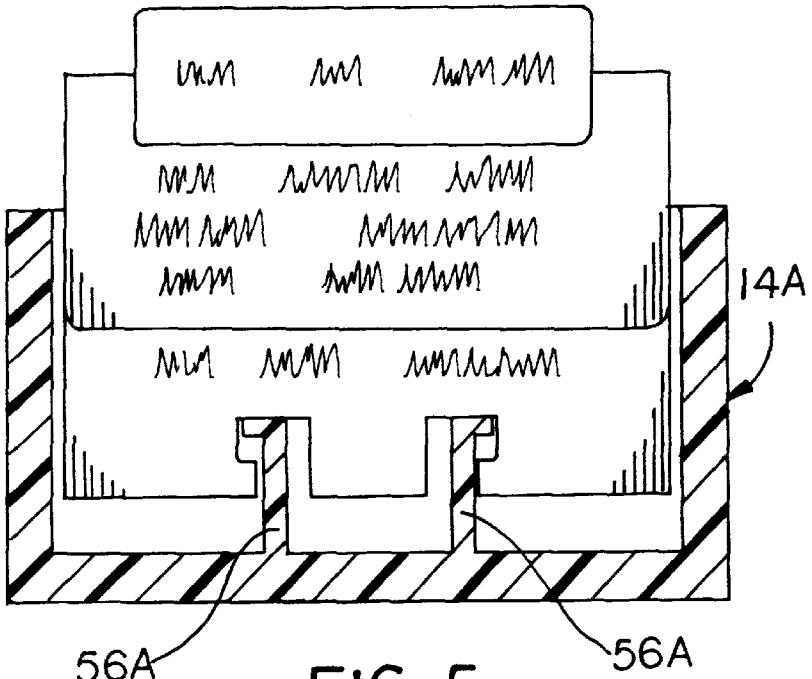
FIG. 5 is a view similar to FIG. 4, but illustrating the card according to the present invention installed in an index file with a wider spacing between the rails supporting the index card than the spacing between the rails in the index file of FIG. 4.
Figure 4:
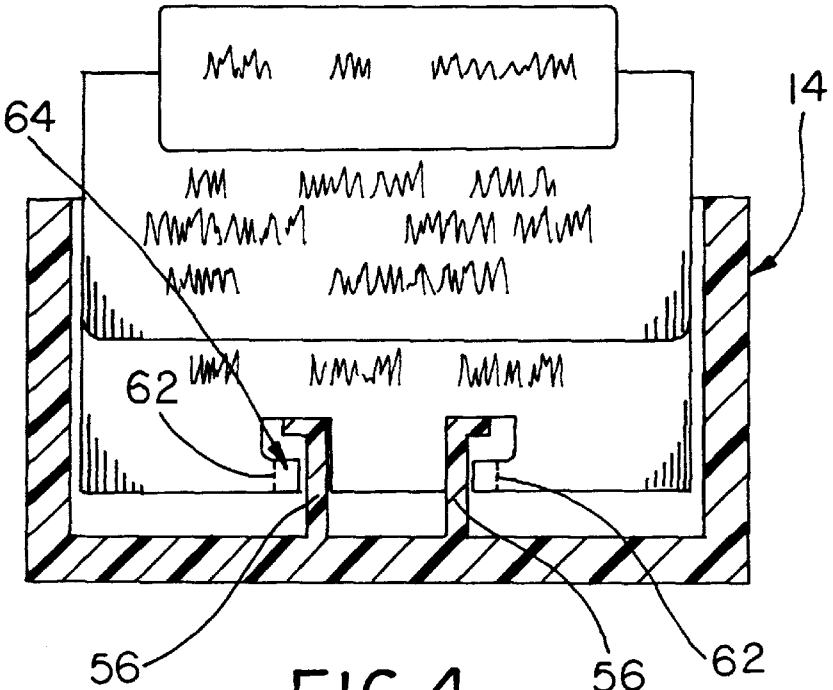
FIG. 4 is a cross-sectional view of the index card of the present invention installed in a flat index file of the same general type shown in perspective in FIG. 6.

Conventional dog leg slots 50 extend inwardly from the lower edge 18 of card 10 to permit installation of the card in a standard index file. Dog leg slots 50 include an entry portion 52 and a laterally extending portion 54 which receives one of the conventional rails 56 which extend upwardly from the bottom of the lateral or flat index file 12 or which receive equivalent projecting portions 58 of disks 60 of rotary files 14. Since the distances between the rails 56 and the disks 60 may vary according to files made by different manufactures, perforations 62 are provided on projecting portion 64 which cooperate with the rest of the card 10 to define the lateral portions 54 of the recesses 50. Accordingly, when it is not possible to install the index card in an index file with the portion 64 in place, the portions 64 can be broken off and discarded, thereby permitting the cards to be installed in files having wider spaced rails 56*a,* 56*b* as illustrated in FIG. 5. The lateral index file 14*a* of FIG. 5 is identical to the lateral index file 14 of FIG. 4, except that the rails 56*a, b* are spaced at a wider distance than are the rails 56 in the lateral index file illustrated in FIG. 4.

What is claimed:

1. Index card for an index file having a supporting rail for supporting index cards in the index file, said card having an upper edge, a lower edge, and opposite side edges extending between the upper and lower edges, said lower edge including means for installing the card in an index file, said installing means includes a dogleg slot having an entry portion extending into said card from said lower edge and a lateral portion extending from said entry portion toward one of said side edges to receive said supporting rail, said lateral portion of the groove cooperating with the lower edge and with the entry portion of the groove to define a projecting section of the card, and a perforation line extending through said projecting section from said lower edge to said lateral portion of said slot to permit a portion of the projecting section defined between said perforation line and said lateral portion to be torn off.

2. Index card for an index file having a pair of laterally spaced supporting rails for supporting index cards in the index file, said card having an upper edge, a lower edge, and opposite side edges extending between the upper and lower edges, said lower edge including means for installing the card in an index file, said installing means including dogleg slots spaced apart along said lower edge, each of said dogleg slots having an entry portion extending into said card from said lower edge and a lateral portion extending from said entry portion toward a corresponding side edge to permit the slots to receive said laterally spaced supporting rails and means for adjusting the size of said entry portion including a perforation line extending between the lower edge and said lateral portion of the slot to accommodate rails having differing lateral spacings.

3. Index card as claimed in claim 2, wherein said lateral portion of each slot cooperates with the lower edge and with the entry portion of the corresponding slot to define a projecting section of the card, said perforation line extending through each said projecting section from said bottom edge to said lateral portion of said slot to permit a portion of the projecting section defined between said perforation line and said lateral portion to be torn off.

4. Improved index card for an index file for holding and displaying conventional index cards having a nominal height, said improved index card having an upper edge, a lower edge, and opposite side edges extending between the upper and lower edges, said lower edge including means for installing the card in said index file, a pair of score lines extending inwardly from each of said side edges toward the other side edge to divide the card into a lower portion including said installing means and an upper portion including said upper edge, said score lines terminating at corresponding edges of a tab projecting from said score lines whereby said upper portion may be folded about said score lines to overlay said lower portion while said tab projects above said score line, said tab extending into a recess in said upper portion before the upper portion is folded about said score lines, said recess also extending below said score lines after the upper portion has been folded about said score lines to expose a section of the lower portion of the improved index card between said score lines and below said tab, indicia being printed on one side of both the upper and lower portions on one side of the card and on the upper portion of the other side of the card whereby upon folding of the upper portion about said score lines a first portion of the indicia on the lower portion of said one side of the improved index card is covered by the upper portion and the indicia on the upper portion of the other side of the improved index card is exposed to a viewer viewing said one side of the improved index card, said indicia covered on said one side being viewable by lifting said upper portion about said score line to expose the indica on both the upper and lower portions of said card, said recess exposing a second portion of the indicia on the lower portion of said one side of the improved index card when the upper portion of the card is folded about the score lines, said score lines defining a folded edge of said improved index card when the upper portion is folded over the lower portion, said tab projecting from said folded edge, said means for installing including a dogleg slot having an entry portion extending into said lower portion from said lower edge and a lateral portion extending from said entry portion to receive a supporting rail carried by the index file, said lateral portion of the groove cooperating with the bottom edge and with the entry portion of the groove to define a projecting section of the card, and a perforation line extending through said projecting section from said bottom edge to said lateral portion of said slot to permit a portion of the projecting section defined between said perforation line and said lateral portion to be torn off.

* * * * *